United States Patent [19]

Lange et al.

[11] 3,989,973

[45] Nov. 2, 1976

[54] COLD-CATHODE GAS-DISCHARGE DEVICE

[75] Inventors: Gerhard Lange; Gerhard Peche, both of Berlin, Germany

[73] Assignee: Siemens Aktiengesellschaft, Berlin & Munich, Germany

[22] Filed: July 31, 1975

[21] Appl. No.: 600,810

Related U.S. Application Data

[63] Continuation of Ser. No. 203,710, Dec. 1, 1971, abandoned.

[30] Foreign Application Priority Data

Jan. 22, 1971 Germany ..... 210007

[52] U.S. Cl. ..... 313/201; 313/209; 313/217; 313/218; 317/62

[51] Int. Cl.[2] ..... H01J 1/46; H01J 17/04; H01J 17/12

[58] Field of Search ..... 313/217, 325, 201, 209, 313/218; 317/61, 62

[56] References Cited

UNITED STATES PATENTS

| | | | |
|---|---|---|---|
| 2,152,998 | 4/1939 | Kelting | 313/217 X |
| 2,228,327 | 1/1941 | Spanner | 313/209 X |
| 2,249,672 | 7/1941 | Spanner | 313/201 X |
| 2,487,437 | 11/1949 | Goldstein et al. | 313/201 X |
| 2,914,695 | 11/1959 | Meyer, Jr. et al. | 313/201 X |
| 2,951,171 | 8/1960 | Holmes | 313/209 |
| 3,564,473 | 2/1971 | Kawiecki | 317/61 X |
| 3,588,576 | 6/1971 | Kawiecki | 313/325 X |
| 3,619,699 | 11/1971 | White | 313/209 X |

FOREIGN PATENTS OR APPLICATIONS

| | | | |
|---|---|---|---|
| 714,842 | 9/1954 | United Kingdom | 313/218 |

*Primary Examiner*—Palmer C. Demeo
*Attorney, Agent, or Firm*—Hill, Gross, Simpson, Van Santen, Steadman, Chiara & Simpson

[57] ABSTRACT

This invention provides a cold-cathode gas-discharge tube comprising a gas-tight, electrical-insulating housing, a control cathode attached to and surrounding the outside of the gas-tight housing, two spaced main electrodes symmetrically mounted in the housing with their frontal surfaces facing each other, metallic rings attached to the frontal surfaces of both main electrodes, and layers of an activating material adhered to the frontal surfaces of both main electrodes within the metallic rings, whereby the main electrodes become in effect hollow electrodes.

1 Claim, 1 Drawing Figure

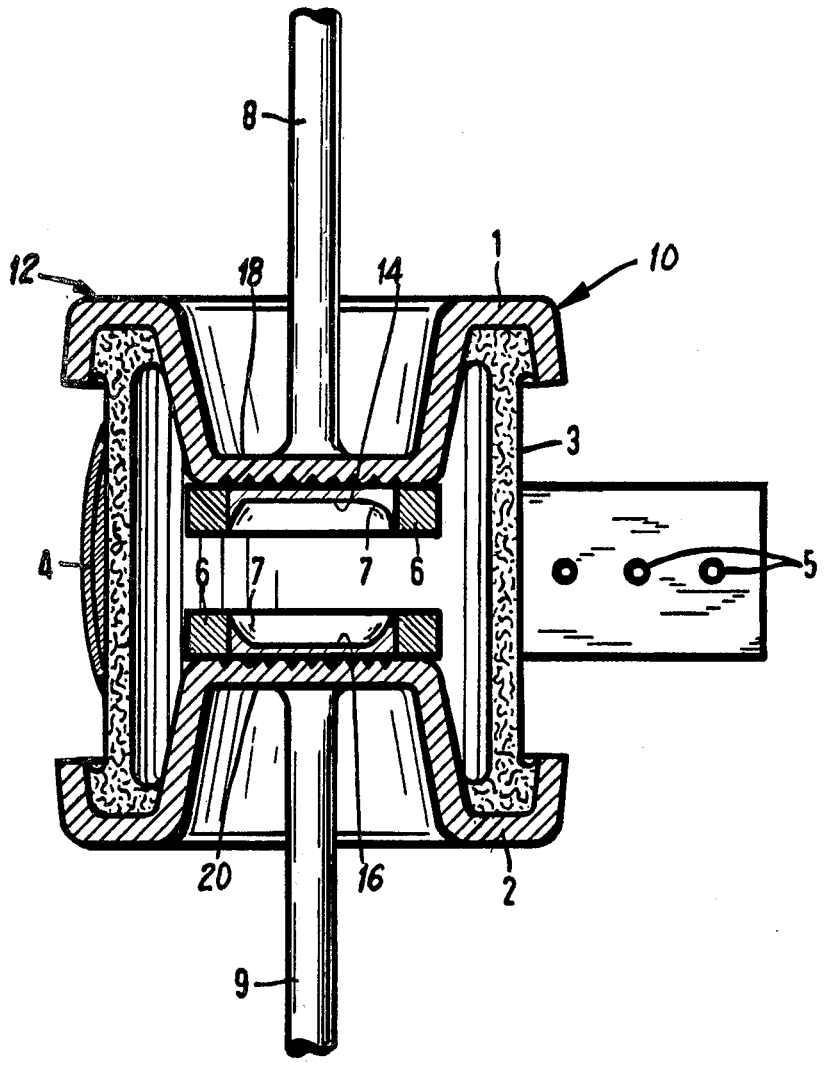
8
12
18
14
1
10
3
4
6
7
7
6
5
20
16
2
9

COLD-CATHODE GAS-DISCHARGE DEVICE

This is a continuation of application Ser. No. 203,710, filed Dec. 1, 1971 and now abandoned.

BACKGROUND OF THE INVENTION

This invention relates to a cold-cathode gas-discharge tube adapted to accommodate a high current load.

There are various types and designs of cold-cathode gas-discharge tubes and each have been designed to impart the maximum amount of electrical heat or light from a source. One type of cold-cathode gas-discharge tube is generally constructed of a gas-tight, electrical-insulating housing having an igniting electrode on the outside of the housing and a pair of main electrodes arranged in a spaced relationship within the housing. With this arrangement of electrodes, this type of gas-discharge tube is advantageous and preferably since it is suited for bipolar applications. Also, this type of gas-discharge tube is much smaller than the comparable gas-discharge tubes.

In this type of cold-cathode gas-discharge tube, the main electrodes are generally shaped in the form of a frustum and inserted into the ends of the tubular gas-tight, electrical-insulating housing. However, this type of gas-discharge tube is not arranged to take and accommodate a high current load but instead takes a low to medium current load as compared with other types of gas-discharge tubes. Moreover, in this type of gas-discharge tubes, the gas placed in and passed through the tubing expands easily and has a tendency to damage or impair the insulation material of the housing. Accordingly, the insulation has to be replaced or the tubing becomes defective and has to be replaced. Thus, there is a need for an improved cold-cathode gas-discharge tube which will take a high current load and which is designed so that the expanding gas will not impair or damage the insulating material over a short period of use.

SUMMARY OF THE INVENTION

We have, accordingly, developed an improved cold-cathode gas-discharge tube which overcomes the disadvantages of the prior art gas-discharge tubes. The improved cold-cathode gas-discharge tube comprises a gas-tight, electrical-insulating housing, a control cathode attached to and surrounding the outside of the gas-tight housing, two spaced main electrodes symmetrically mounted in the housing with their frontal surfaces facing each other, metallic rings attached to the frontal surfaces of both main electrodes, and layers of an activating material adhered to the frontal surfaces of both main electrodes within the metallic rings, whereby the main electrodes become in effect hollow electrodes.

A primary object of the present invention is to provide a cold-cathode gas-discharge tube which is designed to take a high current load.

Another object of the present invention is to provide a cold-cathode gas-discharge tube designed so its insulation will last for a long period of time.

Other objects, features and advantages of the present invention will be readily apparent from the following description of the preferred embodiment thereof, taken in conjunction with the drawing, although variations and modifications may be effected without departing from the spirit and scope of the novel concepts of the disclosure as defined in the appended claims, and illustrated in the drawing which is:

a partial sectional view of a cold-cathode gas-discharge tube embodying the present invention.

DESCRIPTION OF THE PREFERRED EMBODIMENT

In the drawing, there is shown a cold-cathode gas-discharge tube embodying the present invention. The gas-discharge tube, generally indicated at 10, includes a gas-tight housing 12, which has an electrical-insulation layer 3 of a suitable material. Positioned within the housing 12, in a symmetrical spaced relation to one another, are frustum-shaped main electrodes 1 and 2. As shown, the main electrodes 1 and 2 are mounted gas-tightly within the housing 12 with their respective arcs or frontal surfaces 14 and 16 facing each other.

A control electrode 4 is provided as a strip of material which surrounds the outside of the insulated housing 12. The control electrode 4 is connected by means of connectors 5 to the electrical-insulating layer 3 of the housing 12. The control electrode 4 is positioned around the housing symmetrically to the main electrodes 1 and 2. As shown, the control electrode 4 has a width equal to at least the space or distance inbetween the opposing frontal surfaces 14 and 16, of the main electrodes 1 and 2.

On the frontal surfaces 14 and 16 of main electrodes, there is welded or soldered metallic rings 6 which are designed as hollow electrodes, and facing each other. Also, there are coatings or layers 7 of an activating material adhered to the frontal surfaces of the electrodes within the metallic rings 6. With this arrangement of the metallic rings 6 and layers 7 of activating material on the frontal surfaces 14 and 16, the main electrodes become in effect hollow electrodes.

The metallic rings 6 are stamped metal parts which have sharp edges, particularly their upper outer edges. The stamped metal parts 6 are preferably made of iron.

The sharp upper edges of the stamped metal parts 6 lower the external igniting voltage of the gas-discharge tube since there is a condensing of the electric field lines, and thus as a result, there is an increase in field strength at the sharp edges. Furthermore, where the gas volume placed in the gas-discharge tube is pre-ionized, there is provided a good ignition of the tube. Such pre-ionization is generally performed by means of a radio-active substance which is present in the gas-discharge tube.

The layers 7 of activating material applied to the frontal surfaces of the main electrodes, have a high electron emission ability. The activating material may be applied in a large amount to the frontal surfaces of the main electrodes, and when applied within the hollow space of the metallic rings, the activating material has a greater adhesion to the electrode surfaces than when applied to the plain surface of the main electrodes without the metallic rings. Thus, with this arrangement, as shown in the drawing, the main electrodes 1 and 2, with their metallic rings 6 will have the properties of a supply cathode.

The main electrodes 1 and 2, which can consist of, for example, an iron-nickel-cobalt alloy, are thick enough to have metallic connection pieces 8 and 9 soldered or welded, respectively, to their back outer surfaces 18 and 20. The connection pieces are preferably tinned copper wires. The wires or connections 8 and 9 may be inserted and connected to an electric line connected to an electric source for the gas-discharge tube.

The present gas-discharge tube as described above, inherently has the properties to accommodate a high current load as compared with the prior embodiments of the cold-cathode gas-discharge tubes having plain main cathodes. Also, since the gas volume in the operational gap between the main electrodes can expand more easily, the insulating material of the gas-tight housing is less likely to be damaged by inner pressure waves.

Moreover, another advantage of the design of the present gas-discharge tube is that a greater amount of the activating material can be applied to the frontal surfaces of the main electrodes within the metallic rings. Thus, the main electrodes have the properties of a supply cathode.

It will be clear that variations and modifications can be made in the present gas-discharge tube without departing from the scope of the present invention. For example, the control cathode 4, instead of being a strip of material, can be a wire wound around the outside of the insulated housing 12. It is, accordingly, our intention that the scope of the invention be limited solely to that of the hereinafter appended claims.

We claim as our invention:

1. A cold-cathode gas-discharge overload voltage device adapted to accommodate a high current load comprising:

a gas-tight, electrical-insulating housing;

a control electrode attached to and surrounding the outside of said gas-tight housing;

a pair of spaced frustum-shaped main electrodes symmetrically mounted in said gas-tight housing with their frontal surfaces facing each other;

stamped metallic iron rings attached to the frontal surfaces of both main electrodes and said stamped metal rings having sharp edges; and layers of an activating material adhered to the frontal surfaces of both main electrodes within the metallic rings, whereby the main electrodes become in effect hollow electrodes.

* * * * *